US010024622B1

(12) United States Patent
Boester

(10) Patent No.: US 10,024,622 B1
(45) Date of Patent: Jul. 17, 2018

(54) ARCHERY BOW LIMB POCKET ROCKER

(71) Applicant: Bear Archery, Inc., Evansville, IN (US)

(72) Inventor: Theodore J. Boester, Newburgh, IN (US)

(73) Assignee: Bear Archery, Inc., Evansville, IN (US)

( * ) Notice: Subject to any disclaimer, the term of this patent is extended or adjusted under 35 U.S.C. 154(b) by 0 days.

(21) Appl. No.: 15/713,796

(22) Filed: Sep. 25, 2017

(51) Int. Cl.
*F41B 5/14* (2006.01)
*F41B 5/10* (2006.01)

(52) U.S. Cl.
CPC ..... *F41B 5/1403* (2013.01); *F41B 5/10* (2013.01); *F41B 5/14* (2013.01); *F41B 5/148* (2013.01)

(58) Field of Classification Search
CPC ..... F41B 5/10; F41B 5/14; F41B 5/1403
USPC ..... 124/23.1, 25.6, 86, 88, 89
See application file for complete search history.

(56) References Cited

U.S. PATENT DOCUMENTS 5,429,106 A * 7/1995 Martin ..... F41B 5/0026 124/23.1
5,433,792 A * 7/1995 Darlington ..... F41B 5/0026 124/23.1
5,515,836 A 5/1996 Martin et al.
5,697,355 A * 12/1997 Schaffer ..... F41B 5/10 124/25.6
6,024,076 A * 2/2000 Laborde ..... F41B 5/0026 124/23.1
6,244,259 B1 * 6/2001 Adkins ..... F41B 5/0026 124/23.1
6,718,963 B1 4/2004 Wheeler
6,941,937 B2 * 9/2005 Wheeler ..... F41B 5/10 124/23.1
7,025,051 B1 * 4/2006 Gallops, Jr. ..... F41B 5/0026 124/23.1
7,308,890 B1 * 12/2007 Wheeler ..... F41B 5/10 124/23.1
7,334,575 B2 * 2/2008 McPherson ..... F41B 5/0026 124/23.1
7,584,750 B2 * 9/2009 Chang ..... F41B 5/10 124/23.1
8,069,847 B2 * 12/2011 Blosser ..... F41B 5/10 124/23.1
8,448,630 B1 * 5/2013 McPherson ..... F41B 5/1403 124/23.1
8,776,770 B2 * 7/2014 Batdorf ..... F41B 5/10 124/23.1
9,010,307 B2 4/2015 Jolley et al.
9,032,946 B1 5/2015 Mathur et al.
9,103,622 B2 * 8/2015 Park ..... F41B 5/0026
9,581,406 B1 * 2/2017 Nevels ..... F41B 5/1403
9,644,918 B2 * 5/2017 McPherson ..... F41B 5/1403
(Continued)

*Primary Examiner* — Alexander Niconovich
(74) *Attorney, Agent, or Firm* — Woodard, Emhardt, Moriarty, McNett & Henry, LLP; Charles Meyer

(57) ABSTRACT

In certain embodiments the limb pocket of an archery bow includes at least one rocker positioned between the limb pocket and the bow limbs. The rocker is designed to rest or loosely fit in a groove in the limb pocket, and is arranged between the groove and fulcrum points on the limb. The rocker has a length with an upper face which defines one or two limb channels; with each channel engaging the butt end of a limb. In certain embodiments, the rocker sidewalls flex as the limb pocket is assembled to apply a clamping force to the limbs.

21 Claims, 7 Drawing Sheets

(56) References Cited

U.S. PATENT DOCUMENTS

| | | | | |
|---|---|---|---|---|
| 9,702,657 | B2 * | 7/2017 | McPherson | F41B 5/1403 |
| 2008/0127961 | A1 * | 6/2008 | McPherson | F41B 5/10<br>124/88 |
| 2009/0145411 | A1 * | 6/2009 | Sims | F41B 5/10<br>124/25.6 |
| 2014/0190461 | A1 * | 7/2014 | Sims | F41B 5/10<br>124/25.6 |
| 2014/0283804 | A1 * | 9/2014 | Badgerow | F41B 5/1403<br>124/23.1 |
| 2015/0226511 | A1 * | 8/2015 | Chang | F41B 5/1403<br>124/23.1 |
| 2016/0091273 | A1 * | 3/2016 | Denton | F41B 5/0052<br>124/23.1 |
| 2016/0195355 | A1 * | 7/2016 | McPherson | F41B 5/10<br>124/88 |
| 2017/0030674 | A1 * | 2/2017 | Ell | F41B 5/1403 |

* cited by examiner

ARCHERY BOW LIMB POCKET ROCKER

FIELD OF THE DISCLOSURE

The present disclosure relates generally to archery bows and more particularly pertains to an improved limb pocket rocker for use in limb pockets of archery bows and a method for manufacturing the same.

BACKGROUND OF THE DISCLOSURE

Compound archery bows generally including a bow frame having a handle or riser and two bow limbs (or four "quad" bow limbs), plus a cable system on the frame mounted to at least two rotational elements such as wheels. Archery bow limbs perform the function of storing energy when the archer draws the bowstring. When the bowstring is drawn, the pre-stressed bow limbs, which are typically made of resilient material, are further flexed to store additional energy. When the bowstring is released, the stored energy propels the arrow. In conventional compound bows, each limb is typically formed of a single element with a rectangular cross section, where one end is attached to the bow handle and the other end has a limb tip slot formed therein, in which a rotational member such as a wheel, cam or pulley is mounted. In "quad" compound archery bows, two pairs of "quad" bow limbs are used, each having one end attached to the bow handle or riser and the other end coupled with the rotational member.

In certain archery bows, the ends or butt sections of the limbs are received and secured in limb pockets attached to ends of the riser. It is important for the limbs to be properly aligned with the riser and securely mounted to the riser to prevent movement of the limb ends. In many limb pocket arrangements a rocker or spacer is positioned within the limb pocket and slightly spaced away from the end as a fulcrum between the bow and the limb. The rocker contacts portions of the archery bow limbs and moves or rock with the bow limbs as they are flexed during use of the archery bow.

Limb end thickness can vary due to multiple factors such as limb weight, paint buildup, film thickness, etc. This can vary between different bow models for a manufacturer and sometimes between different limb batches made for the same model. Consequently, it can be a challenge to make a standardized limb rocker which fits different limb end thicknesses.

There is a need for improved archery bow limb pocket rockers.

SUMMARY OF THE DISCLOSURE

In one embodiment, an archery bow comprises a riser portion with an upper end and a lower end, and at least one bow limb portion having a butt section. The archery bow includes at least one limb pocket with a rocker positioned between the riser portion and the bow limb portion such that the bow limb contacts the rocker. The rocker is designed to rest or loosely fit in a groove in the limb pocket, and is arranged between the groove and fulcrum points on the limb. The rocker has a length with an upper face which defines one or two limb channels; with each channel engaging the butt end of a limb. Rocker sidewalls flex inward as compression is applied to the rocker during assembly so that said inward lateral faces apply a clamping force to the sidewalls of said limb. Rocker sidewall portions extend upward adjacent the sidewalls of each limb. In certain embodiments, the rocker is configured to flex to apply a clamping force to the limbs as the limb pocket is assembled.

In certain embodiments, the rocker defines a slot extending downward from each limb track into the lower half of the rocker. The slots are adjacent the inward faces of each channel. The slots define hinge portions which allow the channel and end portions of the rocker to slightly flex relative to a central portion in order to apply clamping force to the limbs.

In some embodiments, the lower face of the rocker is formed with a rounded surface to match a rounded groove in the limb pocket. In an uninstalled/non-compressed state, the longitudinal rocker length may define a concave arcuate curve or end portions may be bent slightly downward relative to the center portion.

When the limb pocket and limbs are assembled, the limbs are placed in the channels and press the rocker into the limb pocket groove. The pressure presses the rocker central portion into the groove. Correspondingly, the rocker lateral end portions flex or rotate slightly upward and inward relative to the central portion. This compresses the slots and also flattens the lower surface of the rocker into the limb groove. Correspondingly, the rocker limb tracks are compressed against the limbs, applying a clamping action between the rocker ends and the central portion. The clamping action fits the rocker to the limbs and assists in holding the limbs in place.

Other objects and attendant advantages of this disclosure will be readily appreciated as the same become more clearly understood by references to the following detailed description when considered in connection with the accompanying drawings in which like reference numerals designate like parts throughout the figures thereof.

DETAILED DESCRIPTION OF ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles of the disclosure being contemplated as would normally occur to one skilled in the art to which the disclosure relates.

The present disclosure is directed to limb pocket fulcrums or rockers for use in limb pockets of archery bows. A typical compound archery bow comprises a riser portion with an upper end and a lower end, with bow limbs attached to and extending from the riser, each limb having a butt, tip and hinge section. An archery bow often includes a pair of limb pockets coupled to the upper and lower ends of the riser portion and configured to receive the butt sections of the limbs. Additionally, the archery bow may comprise a pair of rockers positioned within the limb pockets, such that portions of the limbs contact the rockers. The rockers of the present disclosure include aspects that impart a clamping action that fits the rocker to the limbs during assembly and assists in holding the limbs in place.

Figure 1:
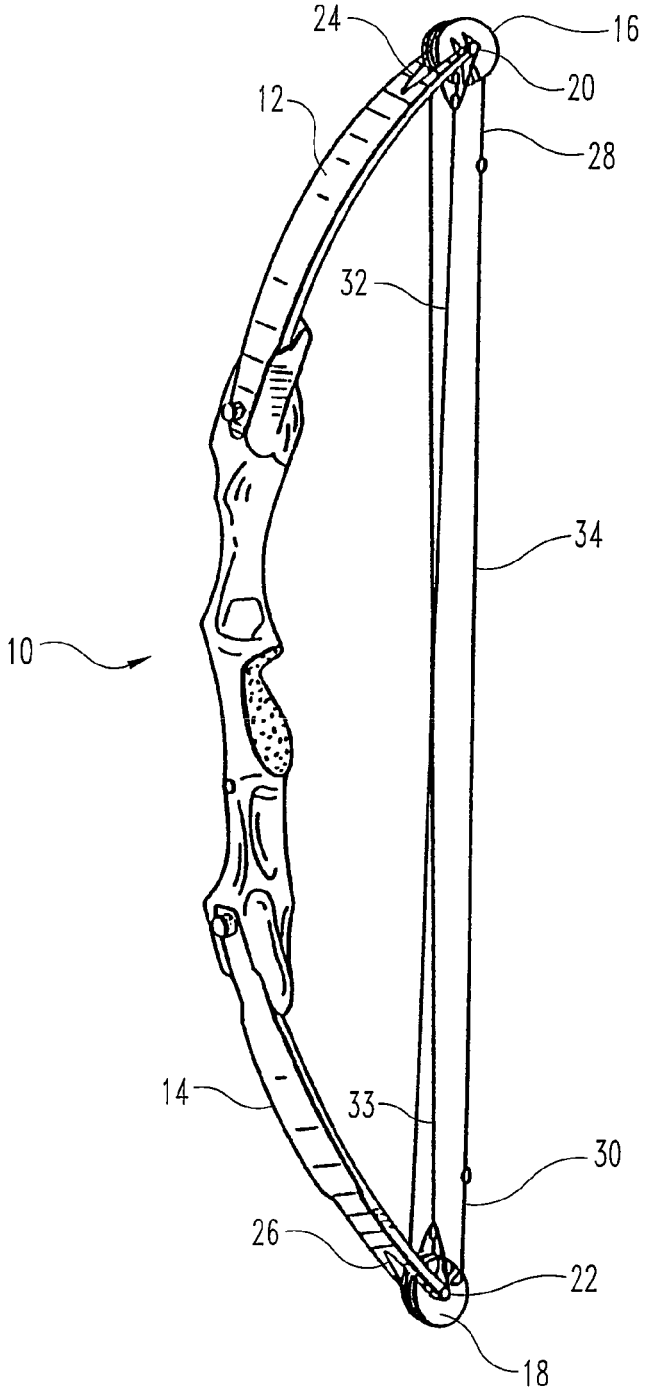
Fig. 1 (PRIOR ART)
FIG. 1 is a perspective view of a prior art compound archery bow.

FIG. 1 illustrates one example of a conventional dual-cam compound archery bow generally designated as 10. When viewed from the perspective of an archer holding the bow 10, it includes a riser with an upper limb portion 12 and a lower limb portion 14. Centrally disposed rotational members forming variable leverage units such as eccentric pulleys 16 and 18 are supported at the limb tip sections for rotary movement about axles 20 and 22. In the embodiment shown, the upper pulley axle 20 is carried in a slot between the outer limb tip portions 24 of upper limb 12. The lower pulley axle 22 is carried in a slot between the outer limb tip portions 26 of lower limb 14.

Bowstring 34 includes upper end 28 and lower end 30 which are fed-out from pulleys 16 and 18 when the bow is drawn. Bowstring 34 may be mounted around pulleys 16 and 18 as is known in the art. As illustrated, Y-yoke anchor cables 32 and 33 each preferably extend from one pulley to the axle of the other pulley.

Figure 3:
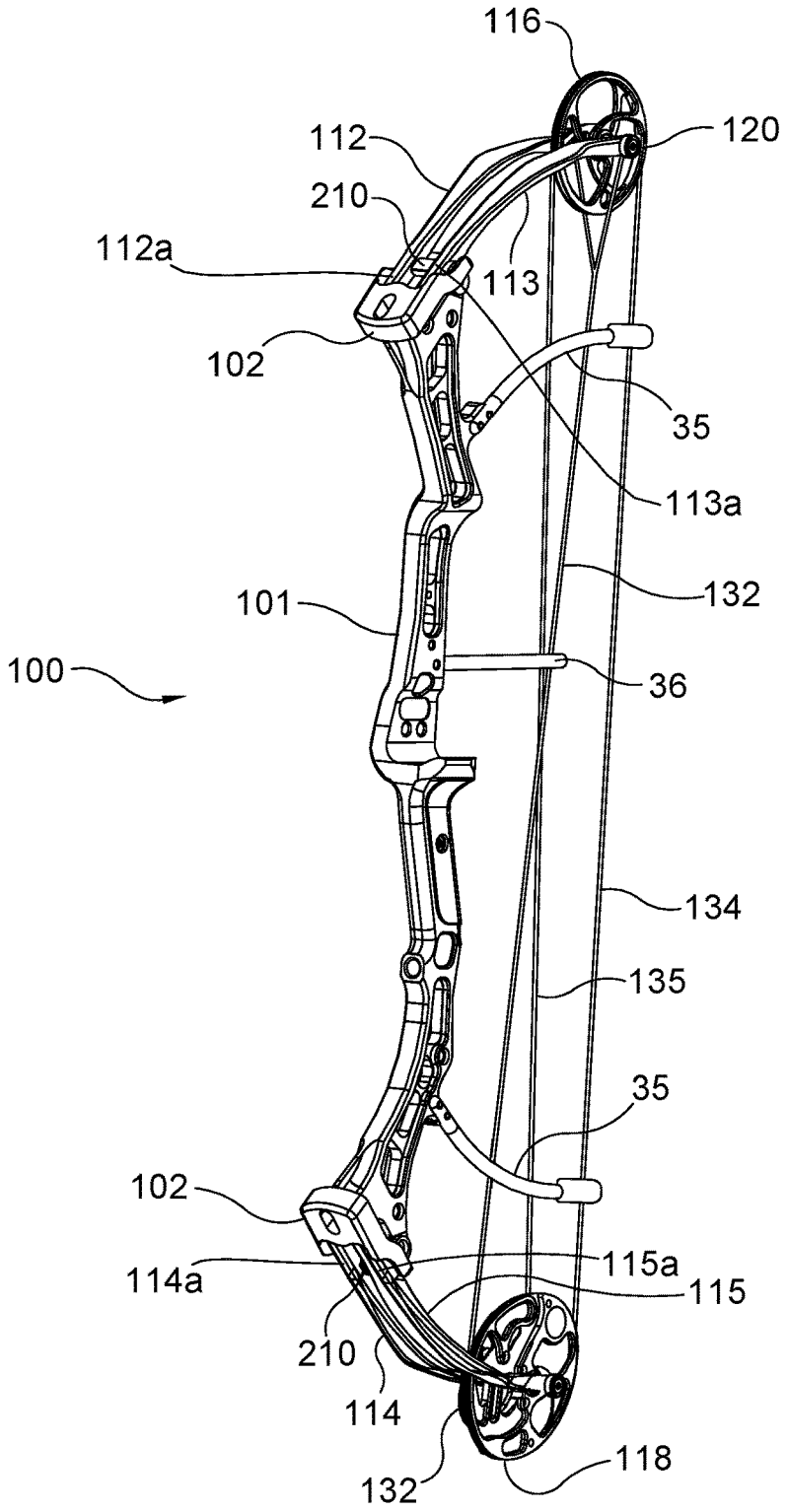
FIG. 3 is a perspective view of a compound archery bow according to one preferred embodiment of the present disclosure.

When the bowstring 34 is drawn, it causes eccentric pulleys 16 and 18 at each end of the bow to rotate, feeding out cable and bending limb portions 12 and 14 inward, causing additional energy to be stored therein. When the bowstring 34 is released with an arrow engaged to the bowstring, the limb portions 12 and 14 return to their rest position, causing the eccentric pulleys 16 and 18 to rotate in the opposite direction, to take up the bowstring 34 and launch the arrow with an amount of energy proportional to the energy initially stored in the bow limbs. Bow 10 is described for illustration and context and is not intended to be limiting. The present disclosure can be used with dual-cam compound bows, or can be used with single-cam bows as illustrated in FIG. 3 and as described for example in U.S. Pat. No. 5,368,006 to McPherson. The present disclosure can also be used in other types of bows, which are considered conventional for purposes of the present disclosure.

Figure 2:
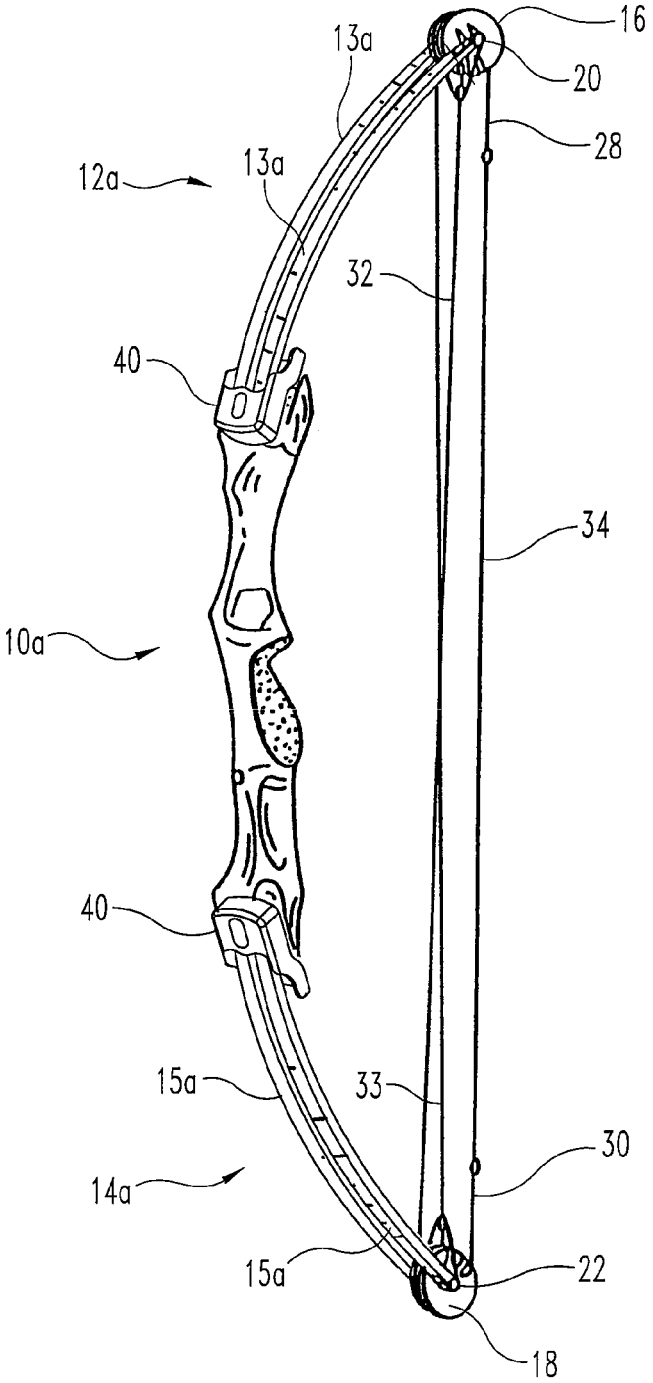
Fig. 2 (PRIOR ART)
FIG. 2 is a perspective view of a prior art compound archery bow with quad limbs.

FIG. 2 illustrates one example of a "quad" dual-cam compound archery bow generally designated as 10*a*. When viewed from the perspective of an archer holding the bow 10*a*, it includes a riser with an upper limb portion 12*a* and a lower limb portion 14*a*. Bow 10*a* also includes limb pockets 40 attached to ends of the riser to receive ends or butt sections of the limb portions. Similar to bow 10, centrally disposed rotational members forming variable leverage units such as eccentric pulleys 16 and 18 are supported at the limb tip sections for rotary movement about axles 20 and 22. In typical "quad" bows, limb portions 12*a* and 14*a* each include two parallel and symmetric "quad" limbs 13*a* and 15*a*, respectively. The illustrated quad limbs are separate members; however, it should be appreciated that in other embodiments the quad limbs may be connected to each other in one or more places. In the illustrated embodiment, the upper pulley axle 20 is carried between the limb tip sections of quad limbs 13*a* and the lower pulley axle 22 is carried between the limb tip sections of quad limbs 15*a*. Bow 10*a* includes bowstring 34 and anchor cables 32 and 33, as described above, and operates substantially in the same manner as described in connection with bow 10.

FIG. 3 illustrates an embodiment of the present disclosure with a "quad" single-cam compound archery bow generally designated as 100. The illustrated bow 100 includes a handle or riser 101 with upper quad limbs 112, 113 and lower quad limbs 114, 115 extending therefrom. In the illustrated embodiment, the limbs are configured such that they receive upper idler wheel 118 between the upper limbs and lower cam 116 between the lower limbs. In the illustrated embodiment, quad limbs 112-115 include flared portions along the length of the limbs. However, it should be appreciated, that the limbs could be sized and configured differently as would occur to one skilled in the art. In the illustrated embodiment, quad limbs 112 and 113 are mirror images, as are quad limbs 114 and 115. Additionally, as illustrated, quad limb 112 is substantially identical to quad limb 115, and quad limb 113 is substantially identical to quad limb 114. The wheels, pulleys and cabling of bow 100 may be conventional. In the illustrated embodiment, bowstring 134 extends between wheel 116 and cam 118, with portion 135 extending from the wheel 116 down to cam 118. A y-yoke anchor cable 132 extends from cam 118 up to the axle of wheel 116. Optionally, bow 100 may include accessories such as dampening rods 35 and a cable guard rod 36, as illustrated.

Bow 100 may include limb pockets 102 attached to the upper and lower ends of riser 101. Pockets 102 are configured to receive butt sections 112*a*-115*a* of quad limbs 112-115 to secure the limbs to the riser. The housing of pockets 102 may be conventional. Positioned within pockets 102 are fulcrums or rockers 210, described in greater detail below. Rockers 210 are configured to contact portions of the bow limbs, and may be configured to at least slightly rotate or rock within the limb pocket corresponding to flexion of the bow limbs during use of the archery bow. In the illustrated embodiment, rockers 210 are used in conjunction with a "quad" archery bow having four total quad bow limbs, with each rocker contacting two quad bow limbs. Accordingly, rocker 210 is also configured to separate the two corresponding quad bow limbs. In other embodiments, each rocker could be used with an archery bow having single bow limbs at each end, such as illustrated in FIG. 1.

Figure 4:
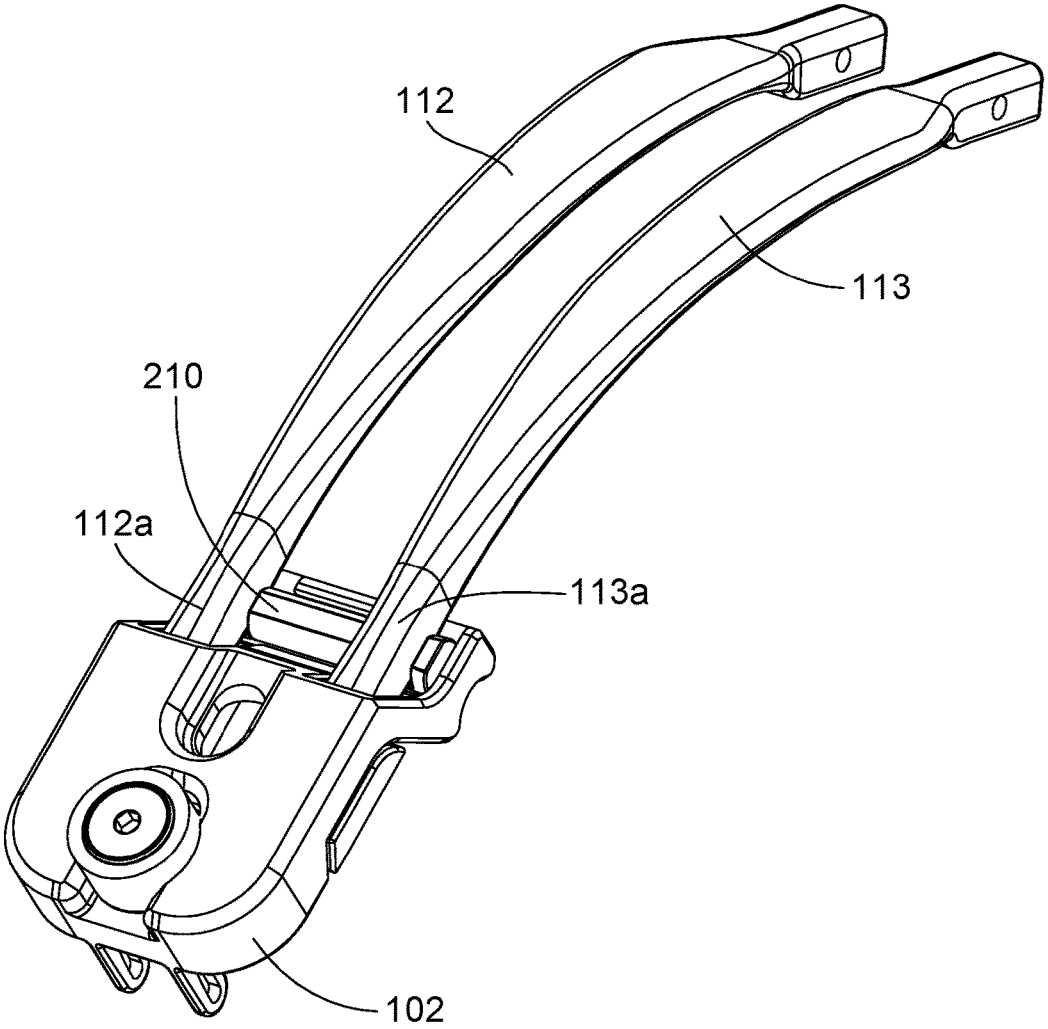
FIG. 4 is a perspective view of a limb pocket assembly and limbs of the compound archery bow according to the embodiment of FIG. 3.
Figure 5:
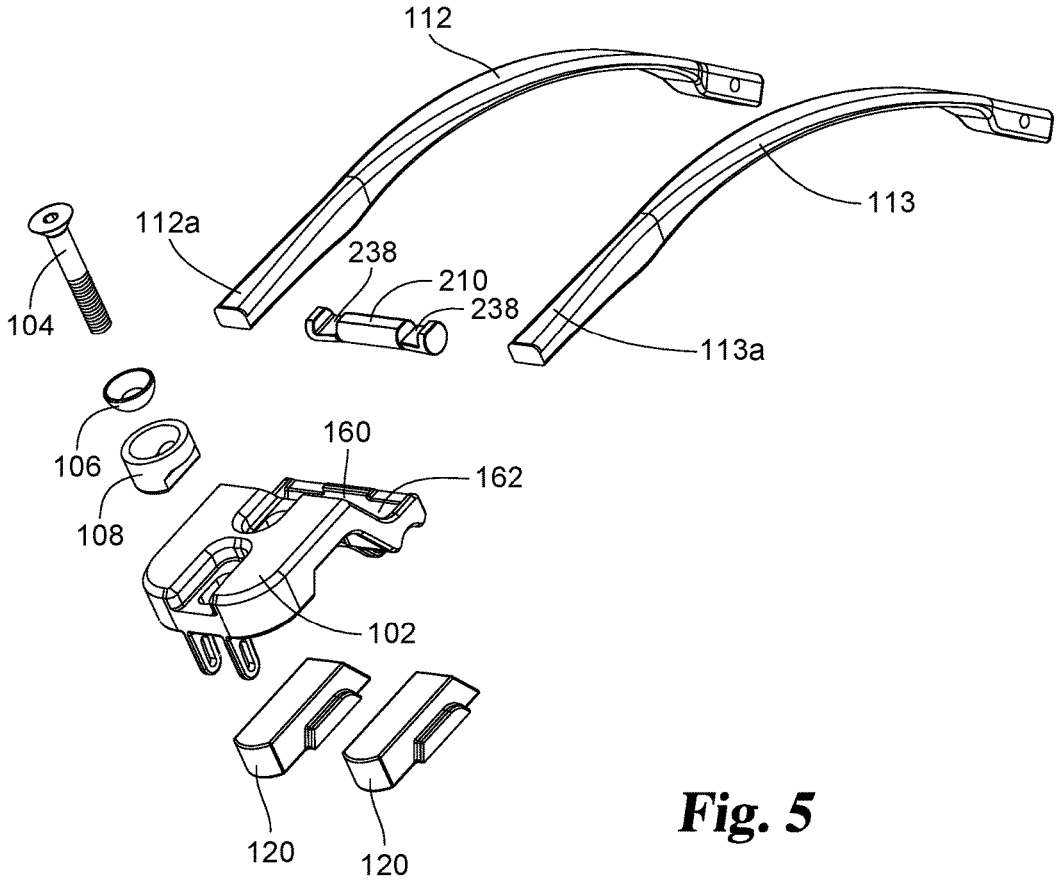
FIG. 5 is an exploded view of the limb pocket assembly and limbs according to the embodiment of FIG. 4.
Figure 6:
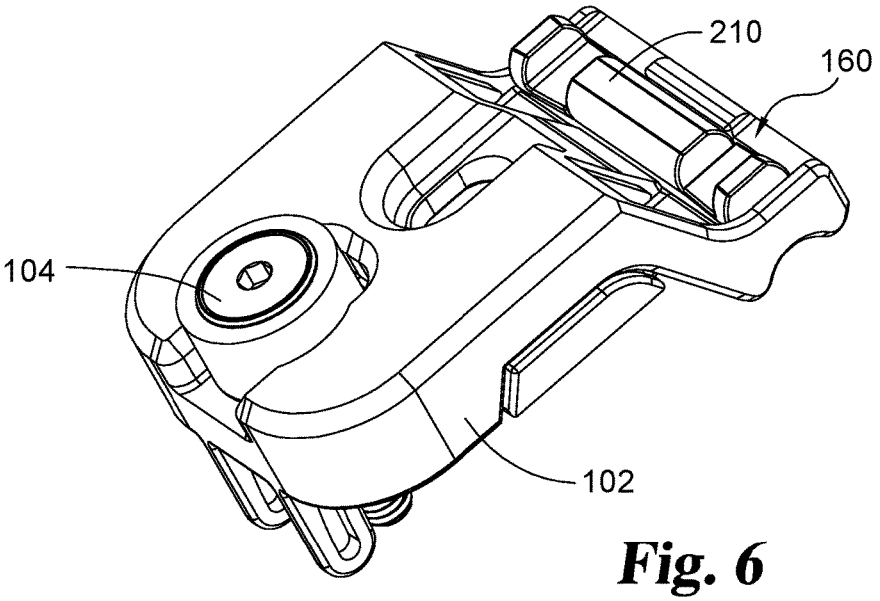
FIG. 6 is a perspective view of the limb pocket assembly of FIG. 4 with the limbs omitted.

FIGS. 4-6 illustrate a rocker 210 with limb pocket 102. The upper limb pocket assembly is shown for purposes of illustration. The lower limb pocket assembly is a mirror image. In the illustrated embodiment, rocker 210 rests (or is loosely fitted) within a groove 160 defined by limb pocket 102. As illustrated in an exploded view in FIG. 5, a limb bolt 104, ball joint sleeve 106 and slider 108 may be used to connect the limb bolt to an end of riser 101. Limb bolt 104 defines an axis and applies a limb clamping force to the limbs during assembly. Butt sections of the quad limbs may be received and secured within boots 120 within limb pocket 102. Alternately, the quad limbs may be positioned and secured within limb pocket 102 in various other manners as would occur to one of ordinary skill in the art. It is also contemplated that in alternative embodiments the limb pocket housings are absent and the rockers are directly coupled to ends of the riser. Rocker 210 generally includes a central portion 220 and a pair of lateral end portions or wing portions 230 having upward facing contact surfaces 232. In a quad limb arrangement, central portion 220 includes a raised limb separator 222 positioned between end portions 230 (see FIG. 7). Portions of the lower face of the butt sections of the quad limbs are configured to contact or rest on the contact surfaces 232 of the rocker, being separated by the raised limb separator 222.

Figure 7:
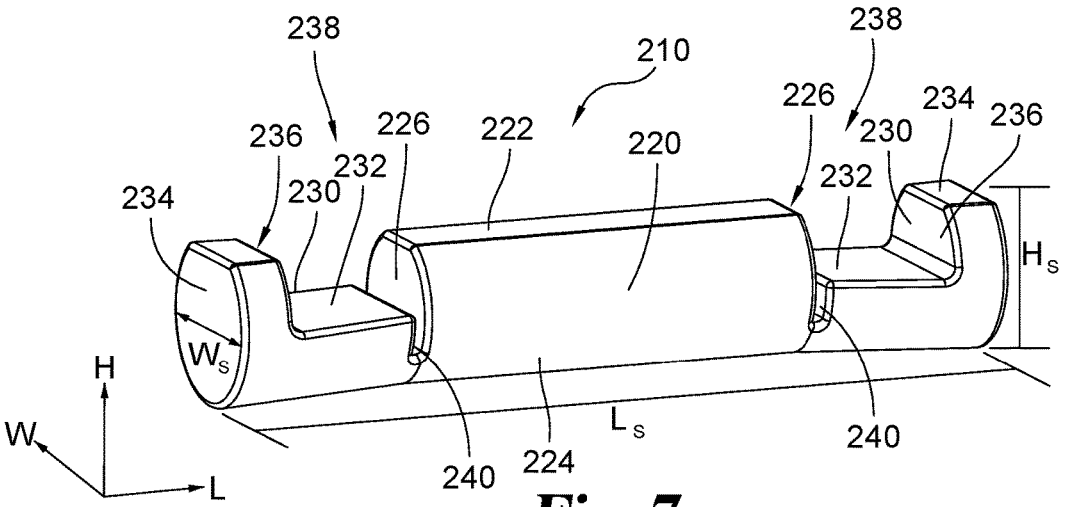
FIG. 7 is a perspective view of a representative limb pocket rocker according to the embodiment of FIG. 3.

As illustrated in FIG. 5, limb pocket 102 includes a seat 160 defining a concave, rounded surface 162 configured to receive the bottom part-rounded portion 224 of rocker 210 (see FIG. 7). In certain embodiments, the configuration and radius of curvature of concave surface 162 matches the configuration and radius of curvature of the convex bottom surface 224 of rocker 210 when assembled. Rocker 210 may slightly rotate or rock within seat 160 via the mating concave/convex surfaces in response to flexing of the bow limbs during use.

Figure 8:
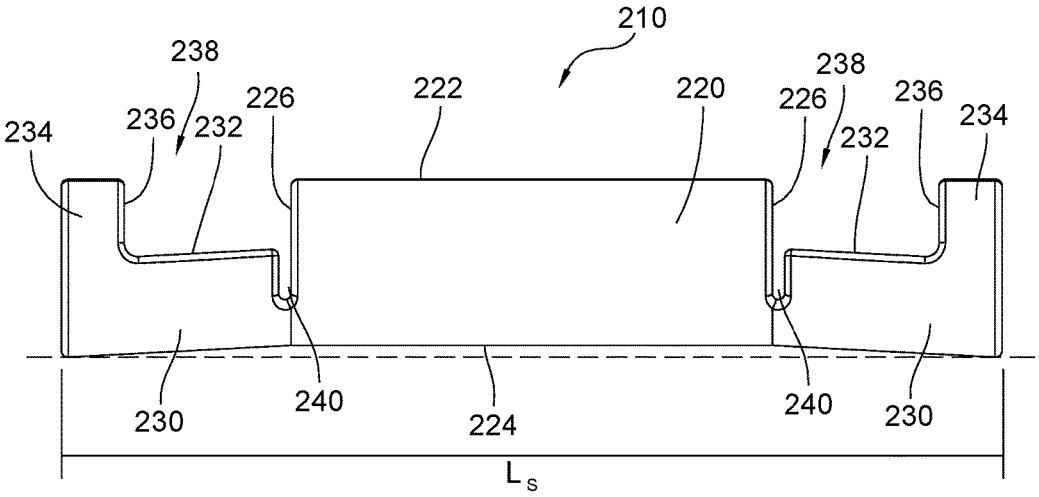
FIG. 8 is a side view of the limb pocket rocker of FIG. 7 in an uncompressed state.
Figure 9:
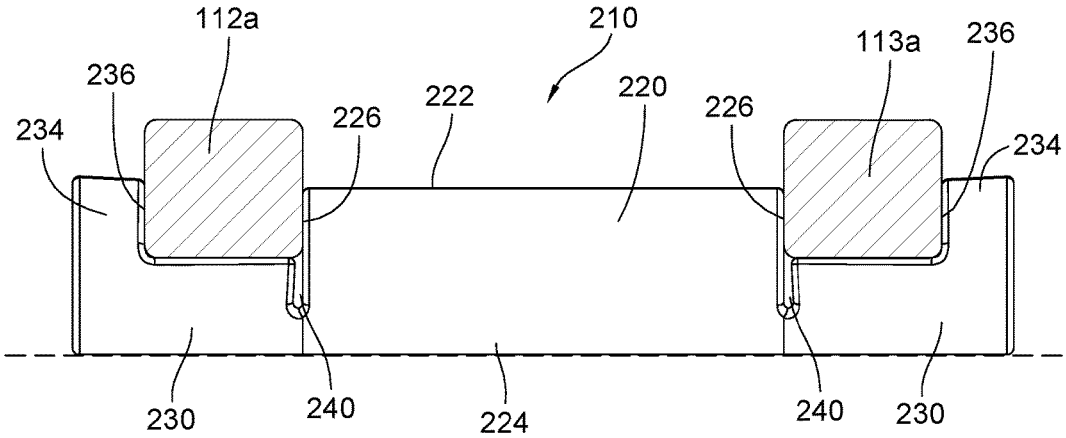
FIG. 9 is a side view of the limb pocket rocker of FIG. 7 with representative limb cross-sections illustrating an assembled and compressed state.

The specific geometry of the illustrated rocker 210 is discussed generally with reference to the various views illustrated in FIGS. 7-9. Rocker 210 includes a length $L_s$ along a longitudinal axis L. Points along curved surface at the top of part-rounded portion 224 define a chord across the top of the part-rounded portion being the illustrated width $W_s$ along axis W. As illustrated, rocker 210 includes a convex curved or rounded bottom surface 224 in a front-to-rear arc around the width $W_s$ defining a part-rounded portion extending along the length $L_s$ of rocker 210 underneath central portion 220 and end portions 230.

Part-rounded portion 224 is configured to sit within seat 160 of limb pocket 210, such that concave surface 162 mates with convex surface 224. Bottom surface 224 may have a different radius (or radii) of curvature than as illustrated, as would occur to one of ordinary skill in the art. In certain embodiments, part-rounded portion 224 may be half-cylindrical spanning approximately 180 degrees. In certain other embodiments, portion 224 may be a greater or less segment of a cylinder (or other rounded shape) as would occur to one skilled in the art. In alternative embodiments, the bottom portion of the rocker may be square or rectangular in shape.

Rocker 201 includes a height $H_s$ along axis H. In a quad limb arrangement central portion 220 has a height $H_s$ forming limb separator 222. Single limb embodiments do not include a limb separator portion. In the illustrated embodiment, central portion 220 defines opposing outward facing lateral faces 226. Lateral faces 226 may be substantially vertical when assembled or optionally the upper portions of faces 226 may taper slightly outward toward end portions 230.

End portions 230 each include an endwall 234 with a height $H_s$ along height axis H. End portions 230 define upward facing surfaces 232 between central portion 220 and endwall 234. Upward facings surfaces 232 may be substantially horizontal when assembled, yet may be slightly skewed from horizontal prior to assembly. End walls 234 each define an inward lateral face 236. Inward lateral faces 236 may be substantially vertical when assembled, or optionally the upper portions of inward lateral faces 236 may taper slightly toward central portion 220. In an unassembled state, inward lateral faces 236 may be slighted skewed from vertical.

In certain embodiments, rocker 210 includes a pair of hinge slots 240. Hinge slots 240 are illustrated with an axis along width axis W and are arranged adjacent to and parallel to outward lateral faces 226. Hinge slots extend downward into rocker 220 below upward facing surfaces 232, partially separating central portion 220 from each end portion 230. The depth of hinge slots 240 is a proportion of yet less than the height of the upward facing surfaces 232, so that the end portions 230 remain connected to central portion 220. In certain embodiments, the depth of hinge slots is forty percent or greater of the height of upward facing surfaces 232. In alternate embodiments, hinge slots 240 may be arranged adjacent to or inward from end walls 234 or hinge slots 240 may be arranged at selected points along the length of upward facing surfaces 232. Slots 240 each define a hinge section, allowing the portions on either side of the hinge section to slightly rotate or flex relative to each other. In alternate embodiment, hinge slots are optional and a hinge affect could be achieved via compression of the rocker material.

In combination, outward lateral faces 226, upward facing surfaces 232 and inward lateral faces 236 define limb tracks 238. As illustrated, a pair of parallel limb tracks 238 are shown corresponding to a quad limb arrangement. In a single limb embodiment, a pair of inward lateral faces 236 and a single upward facing surface 232 define a single limb track, with the upward facing surface 232 extending at a consistent height between lateral faces 236.

FIG. 8 illustrates a side view of rocker 210 in a pre-assembled or uncompressed state. Limb pocket 102 is not shown in FIGS. 8 and 9 for ease of illustration. In the uncompressed state, the lower portion of rocker 210 has a non-linear (i.e. non-straight) profile along its length. In certain embodiments, the lower portion may be slightly raised in height relative to end walls 234 along the length $L_s$. This may be accomplished by forming rocker 210 with a slightly curved lower surface 224 along all or a portion of length $L_s$. Alternately, the rocker may be made or biased to initially define slight bends below hinge slots 240, causing the lower surfaces of end portions 230 to be slightly angled downward relative to the lower surface of central portion 220.

FIG. 9 illustrates rocker 210 and limbs 112, 113 in an assembled or compressed state. When the limb pocket and limbs are assembled, the limbs 112, 113 are initially arranged in rocker 210 with downward facing surfaces of butt sections 112*a*, 113*a* contacting upward facing surfaces 232. Butt sections 112*a*, 113*a* are each arranged with opposing sidewalls facing and between a respective opposing pair of an outward lateral face 226 and an inward lateral face 236. The lateral faces may be in initial contact with the limb sidewalls applying some friction and/or slight retaining force or there may initially be a slight separation between the limb sidewalls and rocker walls. In arrangements with initial contact between the rocker and limb sidewalls, any initial lateral force applied is incidental.

As the limbs are vertically pressed and clamped into place in pocket 102, rocker 210 is clamped between the limbs and the limb pocket. This presses rocker 210 into limb pocket groove 160. This pressure causes end portions 230 to contact groove 160 first. As the rocker continues to be compressed into groove 160, central portion 220 lowers into contact with groove 160 and end portions 230 radially flex or rotate slightly upward and inward relative to central portion 220, along the axes of hinge slots 240. In certain embodiments this causes the inward lateral face to rotate relative to the outward lateral face thus changing the angle between them. The clamping force in combination with the flex and rotation flattens lower surface 224 of the rocker into limb groove 160 along the length of rocker 210, flattening the profile of lower surface 224 along its length into a linear or substantially straight line along axis L.

As end portions 230 radially flex and rotate upward, outward lateral faces 226 are laterally compressed toward inward lateral faces 236. In certain embodiments, outward lateral faces 226 slightly flex and rotate toward inward lateral faces 236. This causes outward lateral faces 226 and inward lateral faces 236 to bear upon and conform to the size and contour of the limb sidewalls, applying a clamping pressure to the sidewalls of limbs 112, 113. Geometrically, the lateral clamping force applied on the limb sidewalls is perpendicular to the vertical limb clamping force applied as the limb is secured to the riser and in the limb pocket. The magnitude of the lateral clamping force applied is also increased and greater than any incidental contact lateral force that may initially exist, for example if the limb is initially friction fitted into a rocker track. The limb sidewall clamping action ensures a snug nested fit between the rocker and the limbs and assists in holding the limbs in place. The clamping action is able to accommodate variations in limb size and thickness.

Rockers 210 are preferably at least slightly flexible and/or compressible to accommodate the varying radius of the bow limbs as they flex during use of the archery bow. Additionally, rockers 210 may be composed of one or more of a variety of appropriate materials, for examples including a plastic or rubber. In certain embodiments, rockers 210 may be composed of a nylon material. It is contemplated that rockers 210 may be formed using an injection molding process involving a mold assembly shaped and configured to form the rockers. In certain embodiments, the material is heated in the mold assembly and then cured by being placed in an oven and heated at a desired temperature. If necessary, final machining may be done to complete the forming process. In certain other embodiments, it is contemplated that rockers 210 may be formed by other appropriate manners. In the illustrated embodiment, the corners within the rockers include radiused corner profiles. These are provided to avoid having to machine grind or cut stress-inducing sharp corners. In such embodiments, the radius corner profiles may be formed by molding in the radius via a mold assembly. There could be greater or fewer radius corner profiles than as illustrated. In other embodiments, radius corner profiles are absent from the rockers.

While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected.

What is claimed is:

1. An archery bow, comprising:

a. a riser with an upper end and a lower end;

b. at least one bow limb having a lower face and a pair of opposing sidewalls;

c. wherein said bow limb is clamped to an end of said riser with said rocker in an assembled state with said rocker arranged at a fulcrum point contacting said lower face;

d. wherein said rocker is formed of a flexible material defining at least one limb track for said bow limb, a central portion and a pair of end portions defining inward lateral faces, with each inward lateral face facing a bow limb sidewall;

e. wherein in an uncompressed state, a lower portion of said rocker has a non-linear profile along its length; and, f. wherein as said bow limb is clamped to said riser during assembly, said rocker is compressed thereby rotating said rocker end portions relative to said central portion so that said lower portion of said rocker has a linear profile along its length, and wherein said inward lateral faces apply a lateral clamping force to the limb sidewalls.

2. The archery bow of claim 1, comprising a limb pocket coupled to one of said upper and lower ends of said riser, wherein said limb pocket receives said bow limb; wherein said lower portion of said rocker defines a rounded bottom along its width and wherein said rounded bottom is positioned within a groove defined by said limb pocket.

3. The archery bow of claim 2, wherein:

a. said at least one bow limb includes a pair of quad bow limbs;

b. wherein said rocker defines a pair of limb tracks each with an upward facing surface with each upward facing surface contacting the lower face of a bow limb;

c. wherein said central portion has a height positioned to separate said quad bow limb members, and wherein said central portion defines a pair of outward lateral faces with each outward lateral face facing a limb sidewall and paired with a respective inward lateral face of an end portion; and, d. wherein in said assembled state each pair of an outward lateral face and an inward lateral face compress a respective quad bow limb applying a clamping force to the sidewalls of said quad bow limb.

4. The archery bow of claim 3, wherein said rocker defines a pair of hinge slots, each hinge slot extending downward from a limb track.

5. The archery bow of claim 1, wherein in an uncompressed state the lower portion of said rocker central portion is slightly raised in height relative to the lower portions of said end portions along the rocker length.

6. The archery bow of claim 1, wherein in an uncompressed state the lower portion of said rocker is curved in height along its length.

7. The archery bow of claim 1, wherein said rocker defines at least one hinge slot arranged between said sidewall portions and extending downward from said limb track.

8. The archery bow of claim 1, wherein each inward lateral face contacts a limb sidewall prior to said rocker being compressed, and wherein as said rocker is compressed during assembly the lateral clamping force substantially increases in magnitude.

9. An archery bow, comprising:

a. a riser portion with an upper end and a lower end;

b. a pair of bow limbs secured to the same upper or lower end, each bow limb having a lower face and a pair of opposing sidewalls;

c. a rocker formed of a flexible material forming a fulcrum member for said bow limbs wherein said rocker defines a pair of upward facing surfaces with each upward facing surface contacting the lower face of a bow limb;

d. wherein said rocker includes a pair of end portions defining a pair of inward lateral faces, and a central portion with a height positioned to separate said bow limbs, wherein said central portion defines a pair of outward lateral faces;

e. wherein each outward lateral face is paired with a respective inward lateral face wherein in an uncompressed state of said rocker each outward lateral face is non-parallel to the paired respective inward lateral face;

f. wherein each pair of an outward lateral face and an inward lateral face extend adjacent opposing sidewalls of a respective bow limb; and, g. wherein as said bow limb is secured to said riser during assembly, said rocker end portions are compressing toward each bow limb causing each pair of an outward lateral face and an inward lateral face to rotate to be parallel and to apply a lateral clamping force to the sidewalls of each limb.

10. The archery bow of claim 9, wherein as said bow limb is secured to said riser during assembly, said rocker end portions rotate upward relative to said central portion causing said sidewalls to laterally compress toward each bow limb.

11. The archery bow of claim 10, comprising a limb pocket connecting said bow limbs to said riser, with butt sections of said bow limbs positioned within said limb pocket and wherein said rocker is positioned in a groove defined by said limb pocket.

12. The archery bow of claim 11, wherein said rocker includes a rounded bottom surface defining a rounded bottom portion extending along its length; wherein when said rocker is in an uncompressed state the rounded bottom surface of said central portion is slightly raised in height relative to the rounded bottom surface of said end portions.

13. The archery bow of claim 9, wherein said rocker defines a pair of hinge slots extending downward from said upward facing surfaces, each hinge slot arranged between an end portion and said central portion.

14. A method of assembling at least one bow limb to a riser of an archery bow, comprising:

a. arranging a rocker made of a flexible material as a fulcrum member for a bow limb relative to a riser with the rocker contacting a lower face of the bow limb wherein the rocker defines at least one hinge slot extending downward from at least one upward facing surface arranged between sidewalls of the rocker;

b. securing the bow limb to the riser thereby applying a limb clamping force to the rocker;

c. wherein as the limb clamping force is applied, compressing the hinge slot and compressing the sidewalls of the rocker to apply a lateral clamping force to sidewalls of the limb, wherein said lateral clamping force is substantially perpendicular to the limb clamping force.

15. The method of claim 14, comprising a. arranging the rocker as a fulcrum member for a pair of bow limbs relative to the riser with the rocker contacting a lower face of each bow limb;

b. positioning a central portion of the rocker to separate the bow limbs;

c. wherein as the limb clamping force is applied, compressing sidewalls of the rocker toward respective outward lateral faces of the central portion to apply a lateral clamping force to the sidewalls of each limb, wherein the lateral clamping force is substantially perpendicular to the limb clamping force.

16. The method of claim 15, wherein the at least one upward facing surface includes a pair of upward facing surfaces on opposing sides of the central portion, and the rocker defines a pair of hinge slots extending downward from the upward facing surfaces, each hinge slot arranged between an end portion and the central portion and compressing the hinge slots as the limb clamping force is applied.

17. The method of claim 15, comprising rotating the rocker end portions upward relative to the central portion along axes defined by hinge slots as the limb clamping force is applied.

18. The method of claim 15, wherein the rocker defines a lower profile along its length and wherein applying the limb clamping force to the rocker changes the lower profile from a non-linear profile to a linear profile.

19. A method of assembling at least one bow limb to a riser of an archery bow, comprising:

a. arranging a rocker made of a flexible material as a fulcrum member for a bow limb relative to a riser with the rocker contacting a lower face of the bow limb wherein the rocker includes a pair of sidewalls and wherein in an uncompressed the sidewalls are non-parallel;

b. securing the bow limb to the riser thereby applying a limb clamping force to the rocker;

c. wherein as the limb clamping force is applied, rotating the sidewalls of the rocker to be parallel and to apply a lateral clamping force to sidewalls of the limb, wherein said lateral clamping force is substantially perpendicular to the limb clamping force.

20. The method of claim 19, comprising rotating end portions of the rocker upward relative to a central portion to apply a lateral clamping force to the sidewalls of the limb.

21. The method of claim 19, comprising flexing end portions of the rocker upward relative to a central portion to apply a lateral clamping force to the sidewalls of the limb.

* * * * *